US009839249B2

(12) United States Patent
Bullock et al.

(10) Patent No.: US 9,839,249 B2
(45) Date of Patent: Dec. 12, 2017

(54) COVER SYSTEM FOR CAPS AND OTHER HEADWEAR

(71) Applicants: Paul Joseph Bullock, Alvin, TX (US); Peggy Bythewood Bullock, Kingsland, TX (US); Edward Coster Bullock, Kingsland, TX (US)

(72) Inventors: Paul Joseph Bullock, Alvin, TX (US); Peggy Bythewood Bullock, Kingsland, TX (US); Edward Coster Bullock, Kingsland, TX (US)

(73) Assignee: Bunkerhead L.L.C., Algoa, TX (US)

( * ) Notice: Subject to any disclaimer, the term of this patent is extended or adjusted under 35 U.S.C. 154(b) by 506 days.

(21) Appl. No.: 13/725,768

(22) Filed: Dec. 21, 2012

(65) Prior Publication Data

US 2013/0180031 A1 Jul. 18, 2013

Related U.S. Application Data

(60) Provisional application No. 61/630,882, filed on Dec. 22, 2011.

(51) Int. Cl.
*A42B 1/06* (2006.01)
*A42B 1/24* (2006.01)

(52) U.S. Cl.
CPC ..... *A42B 1/24* (2013.01); *A42B 1/067* (2013.01)

(58) Field of Classification Search
CPC ..... A42B 1/24; A42B 1/242; A42B 1/241; A42B 3/04; A42B 1/244; A42B 1/245; A42B 1/247; A42B 1/248; A42B 1/067; A42B 1/004; A41D 23/00; A41G 7/00; Y10T 13/1394
USPC ..... 2/209.13, 10, 206, 175.6, 172; 132/57.1, 132/58; 345/8; 362/191, 106
See application file for complete search history.

(56) References Cited

U.S. PATENT DOCUMENTS 4,490,012 A * 12/1984 Magiske ..... 248/476
5,091,996 A * 3/1992 Kirby ..... 2/206
5,274,847 A * 1/1994 Lauttamus ..... G02C 11/00 2/206
5,533,652 A * 7/1996 Levin ..... A42B 1/002 223/24
5,544,361 A 8/1996 Fine et al.
5,669,074 A * 9/1997 Newman, Jr. ..... 2/172
5,692,234 A * 12/1997 Yuen ..... G02C 3/02 2/10
6,381,750 B1 5/2002 Mangan
(Continued)

*Primary Examiner* — Khaled Annis
*Assistant Examiner* — Timothy K Trieu
(74) *Attorney, Agent, or Firm* — The Culbertson Group, P.C.

(57) ABSTRACT

A headwear cover system includes a left receiver base and a right receiver base, each receiver base including a respective receiver adapted to provide an attachment point for an elongated cover support member. Each receiver base is also associated with a respective hat connector which allows the respective receiver base to be connected to the brim of a hat. The elongated cover support member has two connectors, each connector adapted to be releasably secured to a respective one of the receivers. A cover sheet is included in the system and is adapted to be secured along at least a portion of the length of the cover support member. The cover sheet hangs down from the cover support member to provide the desired covering function.

19 Claims, 15 Drawing Sheets

(56) References Cited

U.S. PATENT DOCUMENTS

| | | | | |
|---|---|---|---|---|
| 6,477,744 | B1 * | 11/2002 | Miles | 24/3.12 |
| 6,757,914 | B1 * | 7/2004 | Kobashikawa | A42B 1/247 2/10 |
| 7,207,673 | B1 * | 4/2007 | Ho | A42B 1/247 2/10 |
| 7,343,630 | B2 * | 3/2008 | Lee | 2/175.6 |
| 2004/0078870 | A1 * | 4/2004 | Jones | 2/209.13 |
| 2006/0143799 | A1 * | 7/2006 | Young | A42B 1/064 2/209.13 |
| 2014/0013480 | A1 * | 1/2014 | Treger | A42B 1/247 2/10 |

* cited by examiner

COVER SYSTEM FOR CAPS AND OTHER HEADWEAR

CROSS-REFERENCE TO RELATED APPLICATION

The Applicants claim the benefit, under 35 U.S.C. §119 (e), of U.S. Provisional Patent Application No. 61/630,882 filed Dec. 22, 2011, and entitled "Head and Face Coverings Attachable to a Hat." The entire content of this provisional application is incorporated herein by this reference.

TECHNICAL FIELD OF THE INVENTION

The invention relates to attachments that can be added to baseball-style caps, hardhats, visors, or other types of hats with a bill or brim (hereafter collectively referred to as a "hat"), for the purpose of camouflage, weather protection, or general recreation.

BACKGROUND OF THE INVENTION

In the course of outdoor activities such as hunting, camping, attending outdoor sporting events, and other outdoor recreational activities, it may be desirable to wear head coverings for protection from the elements or insects, or for providing camouflage. With regard to hunting, the prior art includes camouflage face and head covers, or shields, which require the user to don the camouflage material as a full hood that fits over the entire head, or to wrap the material directly around the face and head creating substantial contact with the face and head. Prior art camouflage face coverings may include holes cut into the coverings for the eyes and mouth in order to prevent obstruction to the user's view and breathing. Drawstrings may be provided to bring the material tight around the user's face area. The prior art also includes caps having an integral face cover "sheath" at the front or back of the cap. When in use, the sheath rests on the user's face and when not in use, it is tucked inside the cap. Beyond coverings specifically for hunting, the prior art includes attachments to caps which are designed to protect the user's neck and ears from sunburn and/or from the cold. These attachments may connect to the cap with snaps, hook and loop material, or may be an integral to the cap. Of course the hood of a coat may also be used to provide protection to the head from cold weather conditions.

A consistent problem with prior face and head coverings is that the cover material rests substantially in contact with the user's face and/or neck. This contact with the user's face or neck is commonly uncomfortable to the user and can interfere with breathing when the cover material rests directly across the mouth and nostrils. Another problem with prior face and head coverings is that they are designed with eye and mouth openings which can readily become misaligned with the user's face causing obstruction and the need to realign the covering. Prior face and head coverings can also be disruptive to wearing prescription glasses and sun glasses, and can interfere with eating, drinking, or using hunting calls such as duck or goose calls. There remains a need in the art to provide a face and head covering system which overcomes these and other problems associated with the prior art.

SUMMARY OF THE INVENTION

The present invention comprises a cover material system which may be used with a hat to overcome the above problems and others associated with prior head and face covering devices. The invention includes an apparatus for attaching cover material to a hat and to a hat fitted with the attaching apparatus and cover material.

An apparatus embodying one form of the invention includes a left receiver base and a right receiver base, each receiver base including a respective receiver adapted to provide an attachment point for an elongated cover support member. Each receiver base is also associated with a respective hat connector, which may be a spring-action clipping device, to allow the respective receiver base to be connected to a hat, especially the brim of a hat. The elongated cover support member has a connector preferably at each end which is adapted to be releasably secured to a respective one of the receivers. The cover support member includes at least configurable sections which are bendable into a desired shape and retain that desired shape when released. In some forms of the invention, the cover support member may comprise a length of plastic coated metal wire which is readily bendable into a desired configuration. A cover sheet is included in the system and is adapted to be secured along at least a portion of the length of the first cover support member. The cover sheet hangs down from the cover support member to provide the desired covering function.

Some forms of the present invention may accommodate a second cover support member for providing support for a second sheet of cover material. These forms of the invention may include an additional receiver on each receiver base to provide connection points for the second cover support member. Additional cover sheets may also be used with the present invention as will be described in the description of illustrative embodiments below.

The arrangement of connectors and elongated cover support members according to various embodiments of the present invention allow the cover sheet material to be positioned well away from the user's face to provide superior comfort to the user. The bendable and shape retaining features of the elongated cover support members allows the cover sheet material to be adjusted to suit the user, and to be moved out of the way temporarily to allow the user to eat, drink, or use devices such as duck calls. Also, the invention may be used with many different types of hats, and may be moved from one hat to another for different uses.

These and other advantages and features of the invention will be apparent from the following description of illustrative embodiments, considered along with the accompanying drawings.

DESCRIPTION OF ILLUSTRATIVE EMBODIMENTS

Figure 1:
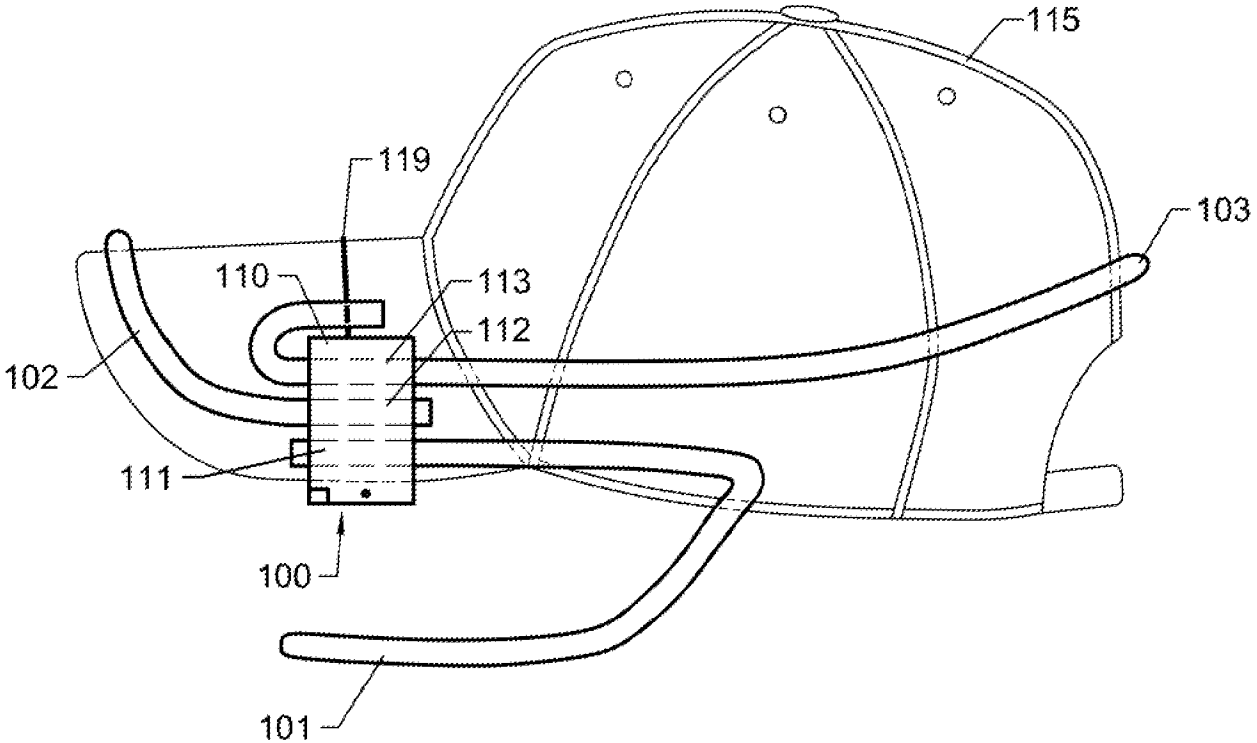
FIG. 1 is a left side view of a ball cap-type hat on which an apparatus according to one embodiment of the invention is mounted, less the cover sheets so as to expose the underlying mounting structure.
Figure 2:
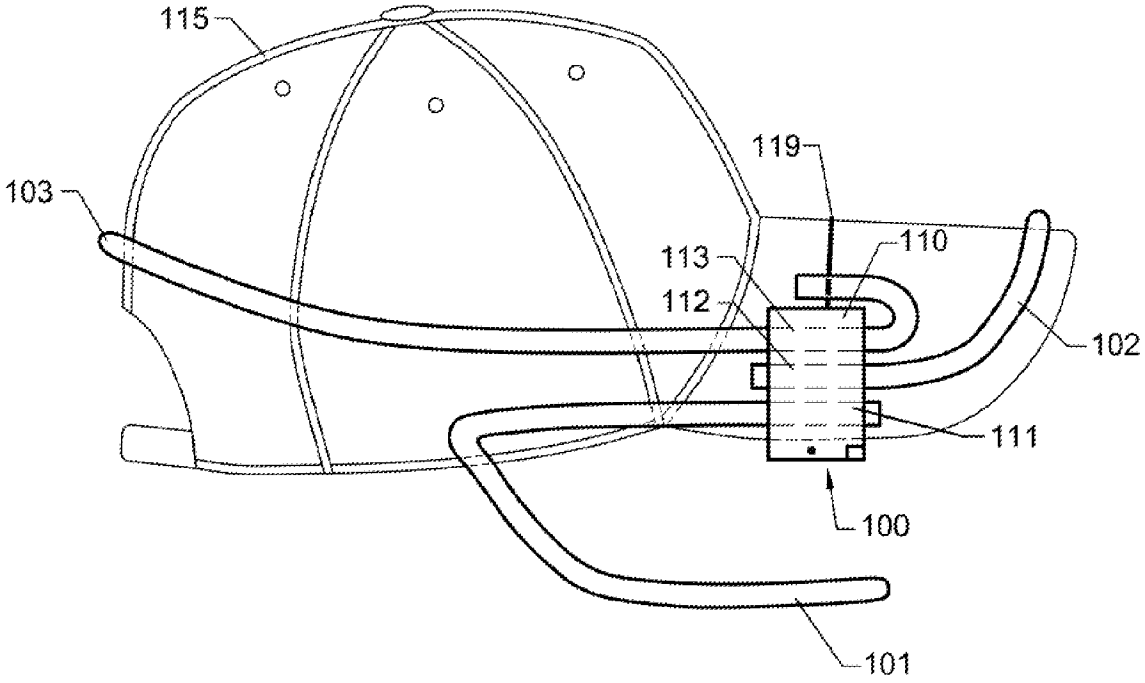
FIG. 2 is a right side view of the hat and apparatus shown in FIG. 1.
Figure 3:
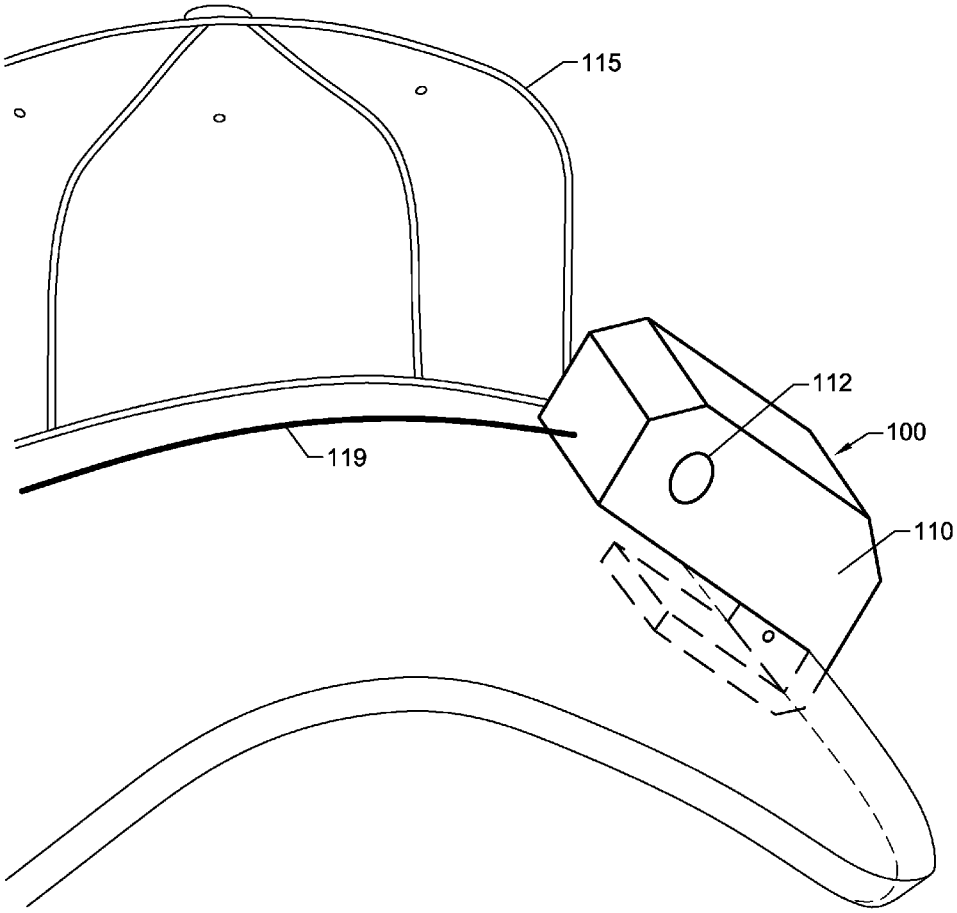
FIG. 3 is an enlarged front perspective view showing one receiver base in a connected position on a hat.
Figure 4:
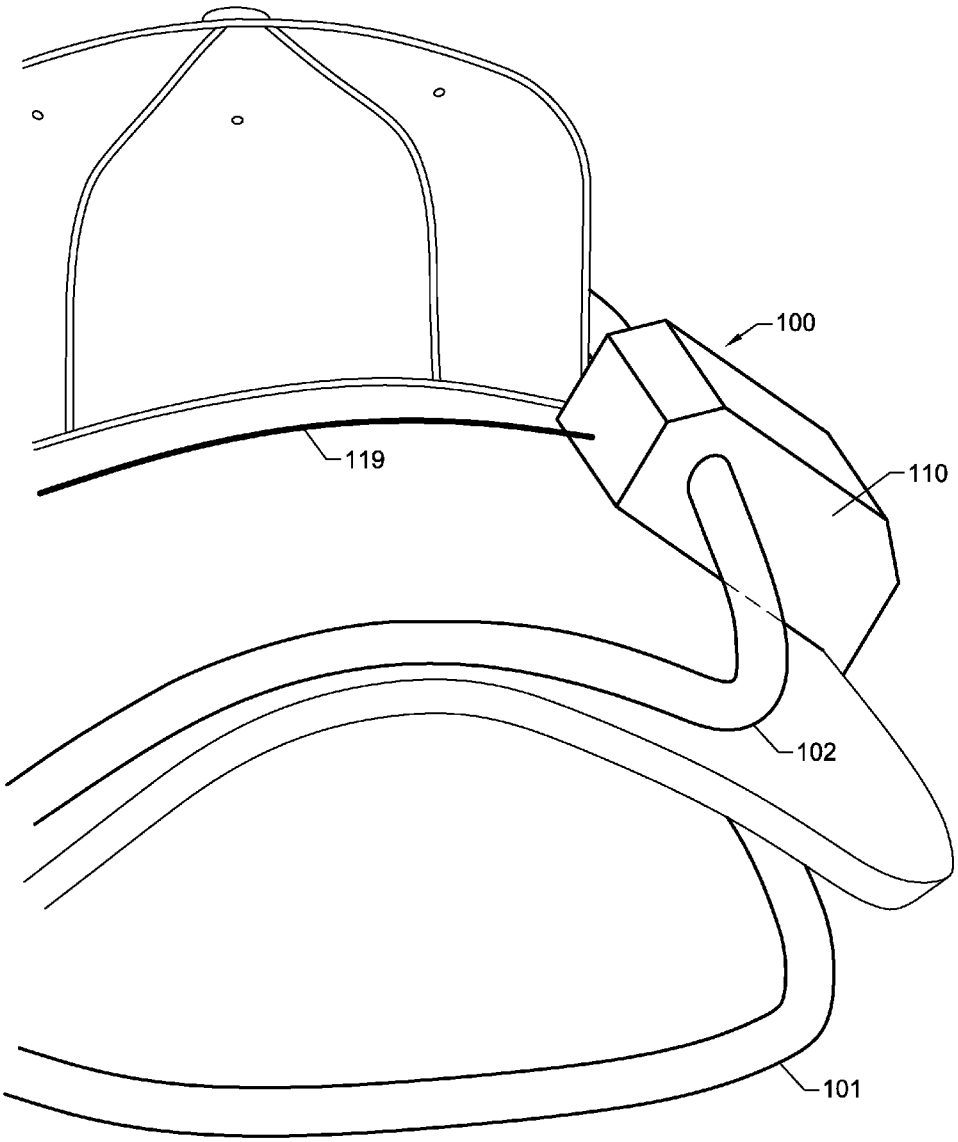
FIG. 4 is a view similar to FIG. 3, but showing elongated cover support members on the hat.
Figure 5:
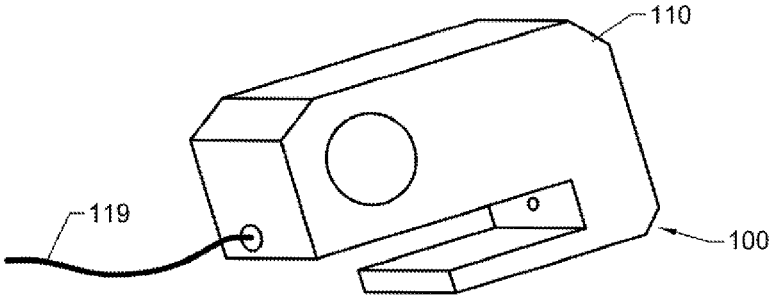
FIG. 5 is a view in perspective of an anchor point device according to an embodiment of the invention.

As shown in FIGS. 1-3, a headwear cover system according to certain forms of the invention includes left and right anchor point devices shown generally at 100. The anchor point devices 100 shown in FIGS. 1-3 provide connection points for three separate elongated cover support members, a lower face cover support member 101, an upper face cover support member 102, and a side/back cover support member 103. The cover support members 101, 102, and 103 are each adapted to support sheets of cover material such as the cover material sheets 106, 107, and 108 shown in FIGS. 13-16 and described further below.

In the example of FIGS. 1-3, each anchor point device 100 includes a receiver base 110, and one receiver for each cover support which may be used with the cover system. FIGS. 1-3 show the respective receiver base 110 residing in a respective operating position on the brim of a hat 115. The receivers each comprise an opening in this particular embodiment, namely, receiver openings 111, 112, and 113 in each receiver base 110. Each of the receiver openings 111, 112, and 113 is adapted to receive an end portion of the respective cover support member 101, 102, or 103 in a frictional engagement to releasably connect the respective cover support member to the respective receiver base 110.

Figure 9:
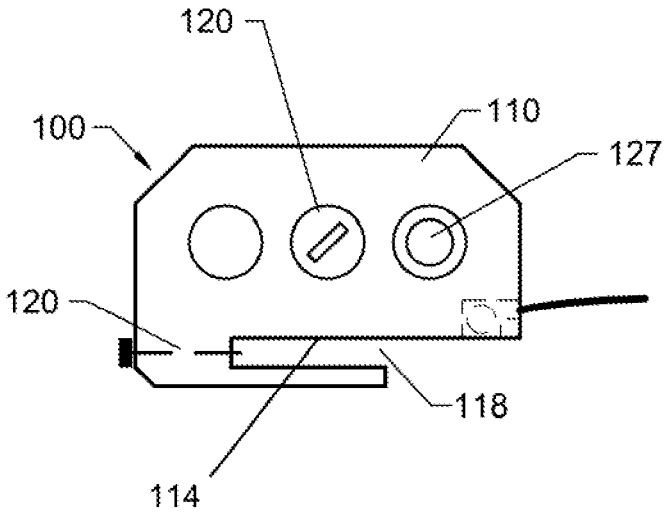
FIG. 9 is a back view of an anchor point device according to one form of the invention.
Figure 10:
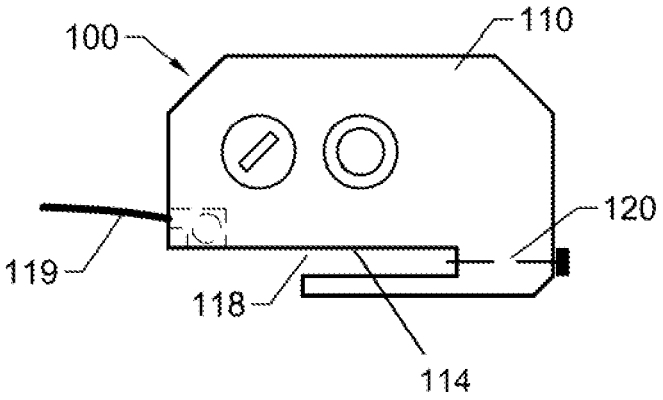
FIG. 10 is a front view of the anchor point device in FIG. 9.

Each illustrated anchor point device 100 also includes a hat connector which connects the respective receiver base 110 to the hat 115 with which the cover system is used. In the embodiment shown in FIGS. 1-3, the hat connector for each receiver base 110 includes a slot opening 118 (shown in FIGS. 9 and 10 for example) adapted to receive an edge of hat 115, an elastic tether 119 which is shared between the two receiver bases, and a respective pin 120 in position to bite into the edge of the hat received in the respective groove structure. An alternate hat connector is illustrated in FIGS. 20-22, and includes a spring material clip 122, which is adapted to clip on an edge of a hat and form a frictional connecting engagement by the spring force of the clip material.

Figure 20:
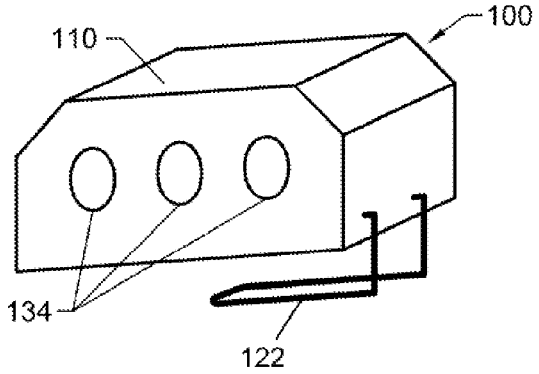
FIG. 20 is a side perspective view of an alternate anchor point device according to the present invention.
Figure 21:
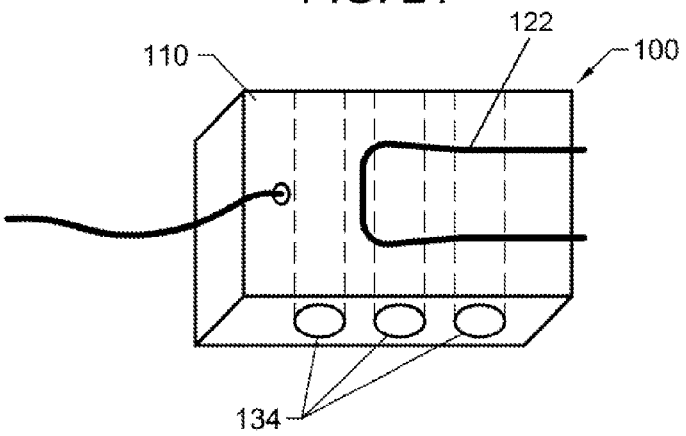
FIG. 21 is a bottom perspective view of the anchor point device shown in FIG. 20.
Figure 22:
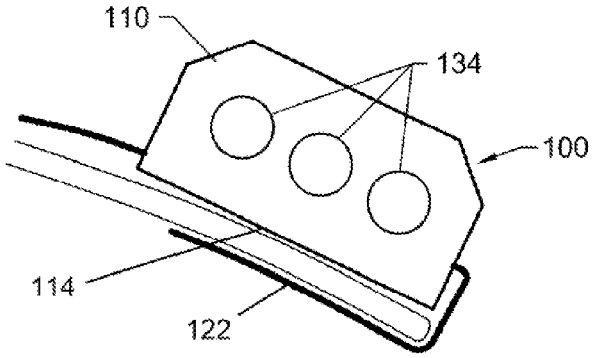
FIG. 22 is an end view of the alternate anchor point device in an installed position on a hat.

In the embodiments shown in both FIGS. 1-3 and in FIGS. 20-22, the receiver base 110 includes an attachment surface comprising the surface which faces and contacts the brim of the hat 115 when the receiver base is in the operating position such as the position shown in FIGS. 1-3. This attachment surface 114 is shown particularly in FIGS. 9, 10, and 22.

Figure 11:
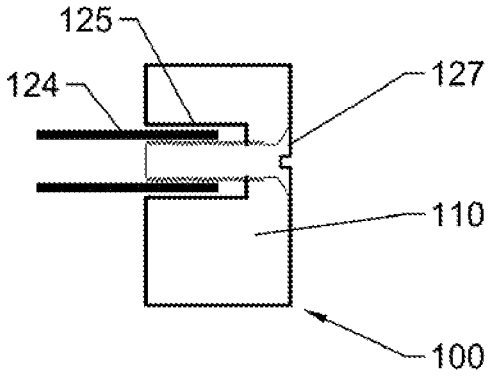
FIG. 11 is a diagrammatic representation showing a lug connection according to one form of the invention.
Figure 12:
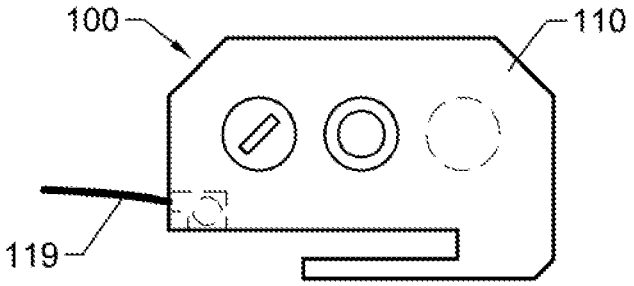
FIG. 12 is a front view of an anchor point device according to one form of the invention.
Figure 13:
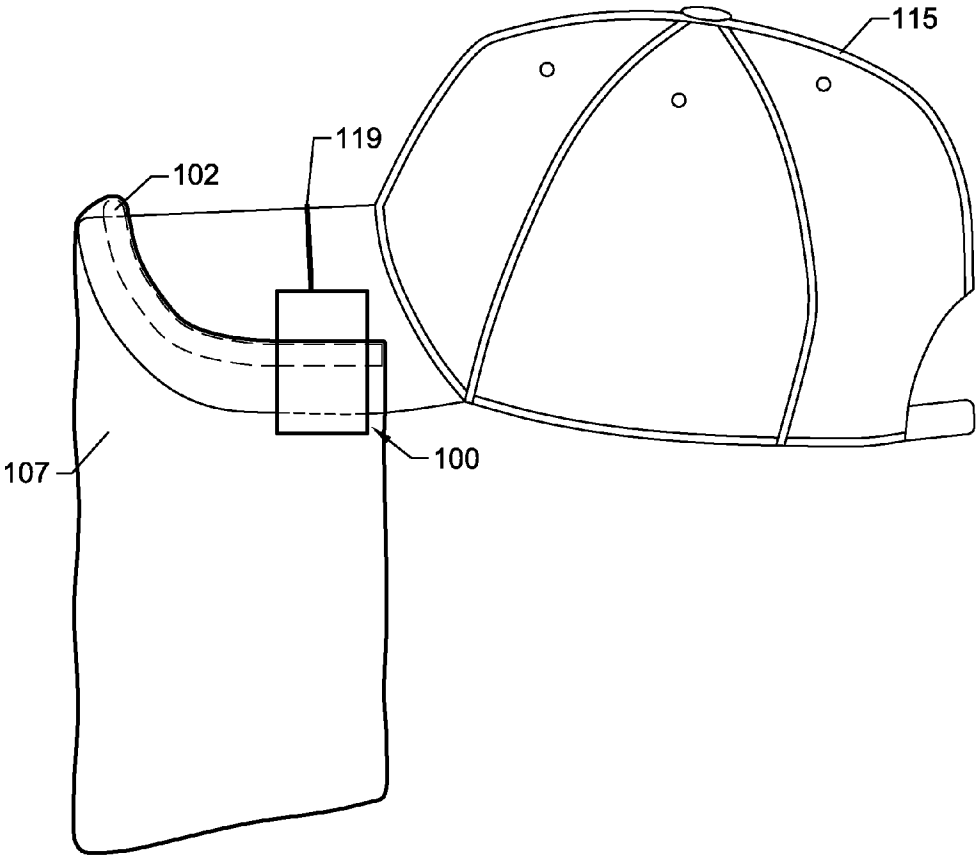
FIG. 13 is a left side view of a hat having an upper face attachment according to one form of the invention.
Figure 14:
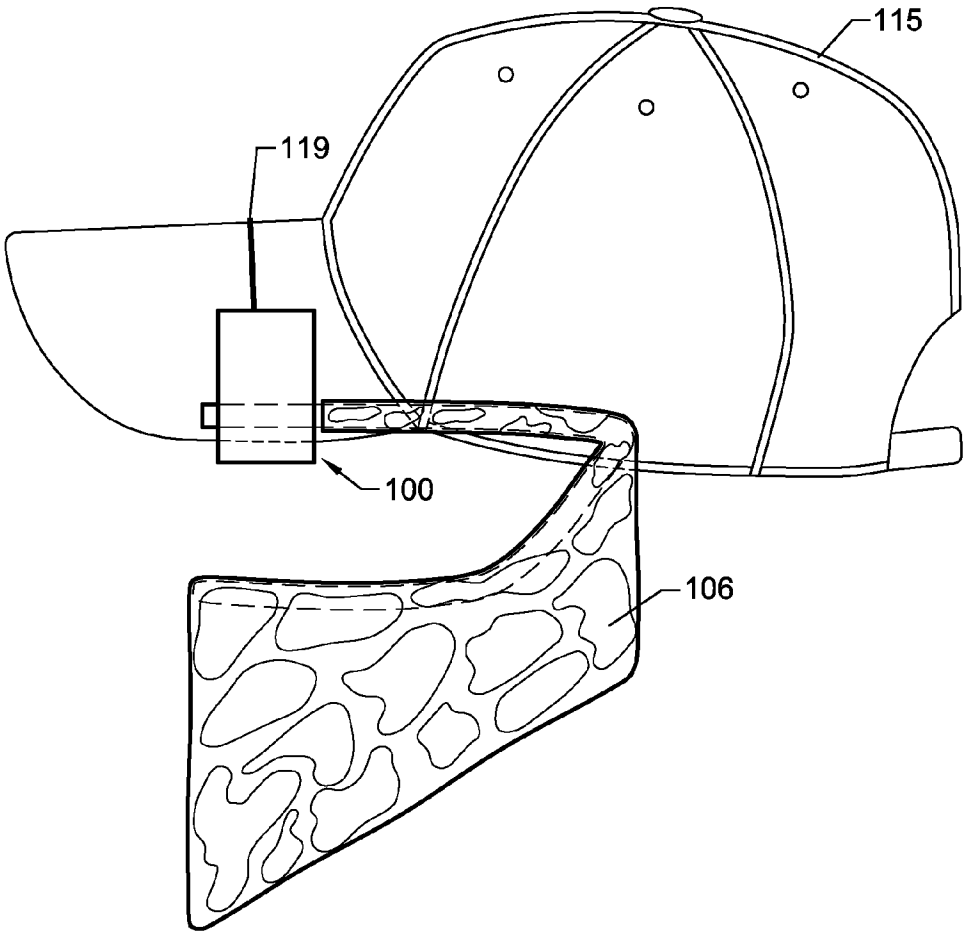
FIG. 14 is a left side view of a hat with a lower face cover according to one form of the invention.
Figure 15:
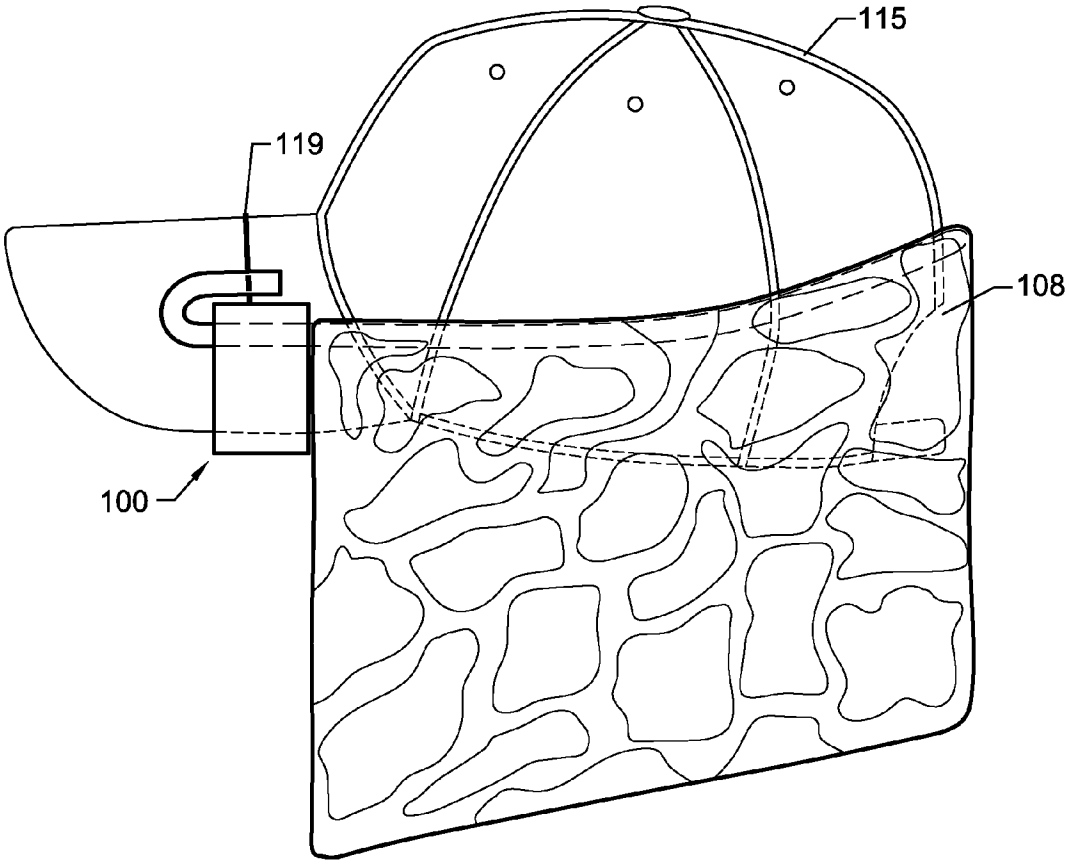
FIG. 15 is a left side view of a hat with a side and back cover attached according to an embodiment of the invention.
Figure 16:
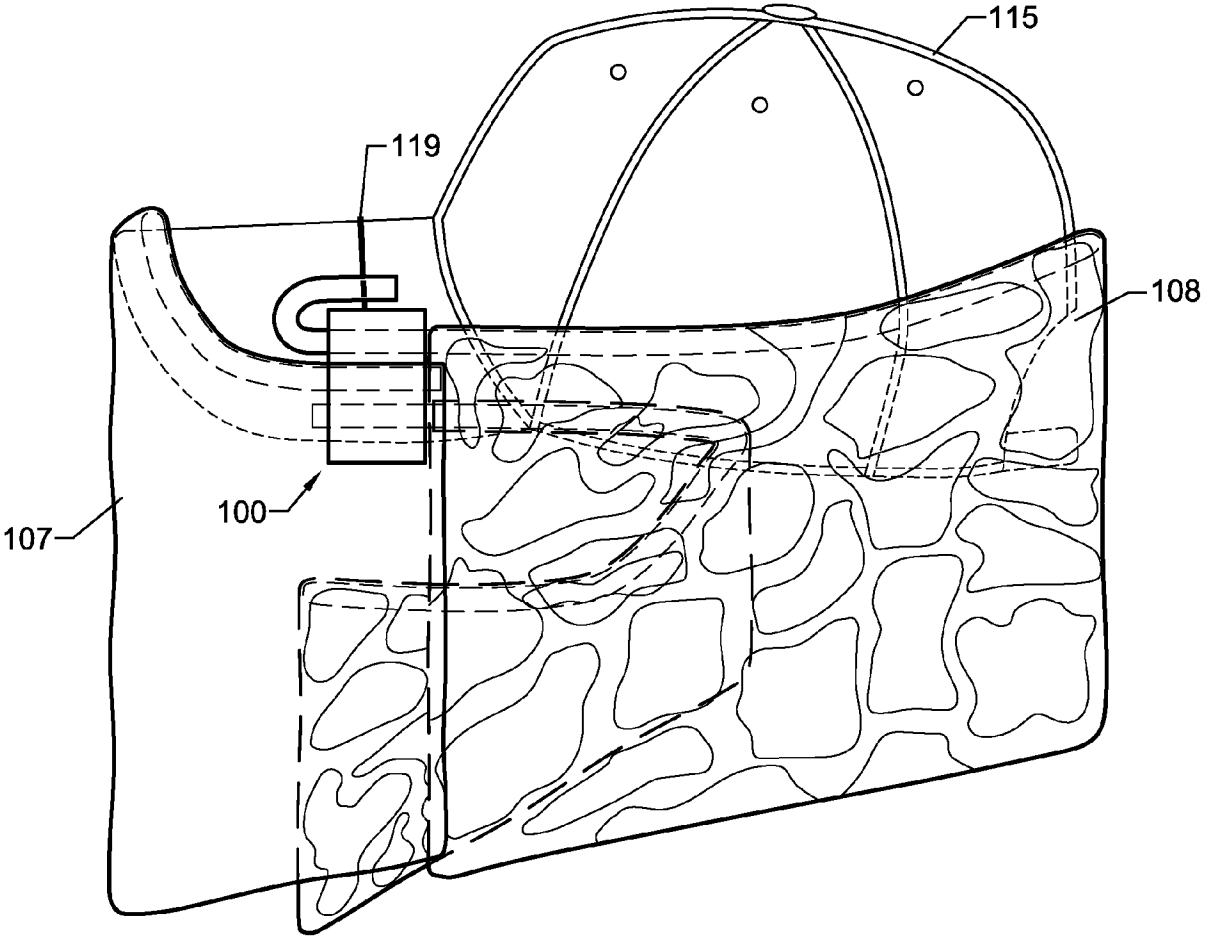
FIG. 16 is a left side view of a hat having the side and back cover, the lower face cover, and upper face cover attached.

The drawings illustrate three different types of receivers which may be used to connect to a respective cover support member 101, 102, or 103. A lug type receiver is shown in several of the figures, but perhaps best in FIG. 11. The lug-type receiver is adapted to receive an end of a cover support member which has the form of a resilient tube material 124 in FIG. 11, and includes a receiver opening 125 in the receiver base 110 and a lug/bolt opening in the opposite side of the receiver base concentric with the receiver opening 125. In operation, the end of the tubing 124 is inserted into receiver opening 125 and then an appropriately sized lug/bolt 127 is threaded into the lug/bolt opening. As the distal end of lug/bolt 127 threads into the open end of tubing 124, it causes the resilient tubing material to expand sufficiently to provide a good frictional engagement at least with the threads of the lug/bolt and perhaps also with the wall of receiver opening 125. Tubing 124 is retained in place by the frictional engagement between the tubing material and the threads of the lug/bolt 127 and perhaps by frictional engagement between the tubing 124 and the wall of receiver opening 125.

Figure 6:
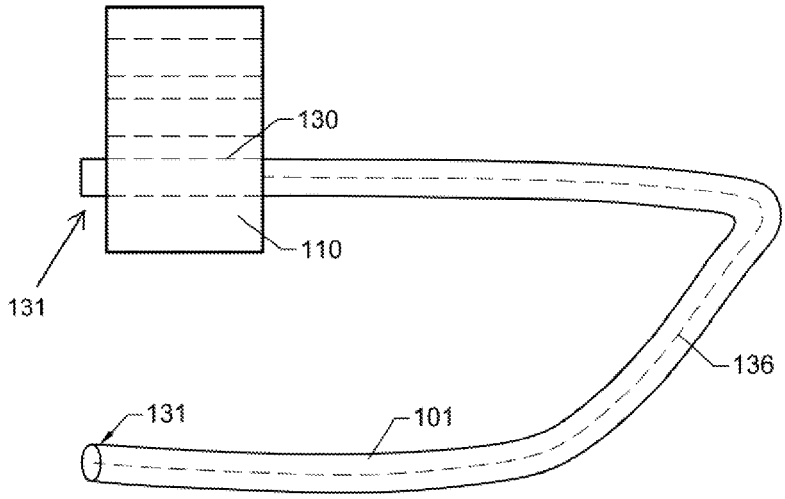
FIG. 6 is a diagrammatic view of a cover support member and anchor point device according to a form of the invention.

Another type of receiver is shown in several of the figures, but perhaps best in FIG. 6. This type of receiver is adapted to be used particularly with wire-type cover support members which will be described below, although it may also be used with tubing-type cover support members (such as tubing 124 in FIG. 11). The alternate type of receiver shown in FIG. 6 comprises simply an appropriately sized receiver opening 130 extending partially through receiver base 110. Receiver opening 130 is sized so that it has a transverse dimension slightly smaller than a transverse dimension of the end 131 of the cover support member 101. Thus when the end 131 of the cover support member is inserted into receiver opening 130, the resilient material at that end 131 deforms to fit in the opening and presses against the wall of the opening to provide a good frictional engagement.

FIGS. 20-22 illustrate another alternate receiver which comprises simply a receiver opening 134 (3 in FIGS. 20-22) which extend all the way through the receiver base 110. This alternate type of receiver opening functions similarly to a receiver opening which extends only partially through the receiver base 110, except that the end of the cover support member may be inserted all the way through the receiver base to provide a measure of adjustability for the respective cover support member (not shown in FIGS. 20-22).

Figure 6A:
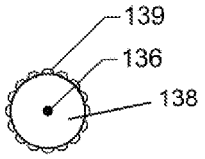
FIG. 6A is an end view of an end of the cover support member shown in FIG. 6.
Figure 7:
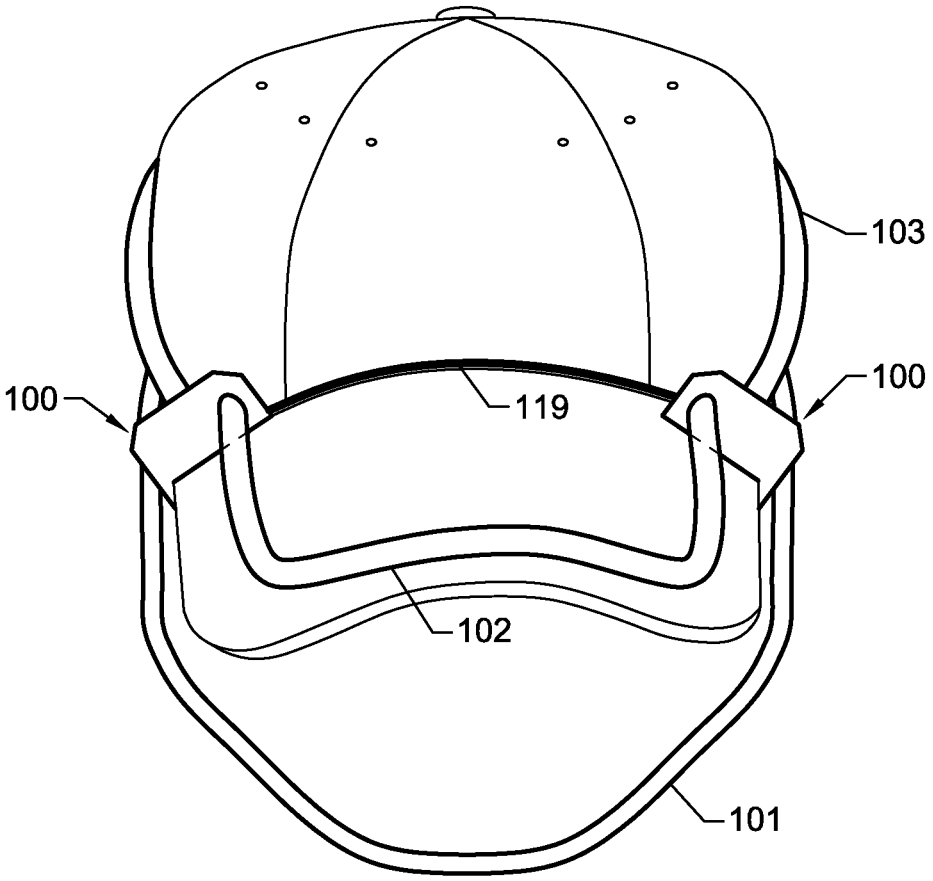
FIG. 7 is a front view of a hat on which a device according to the invention is mounted, but without cover material sheets.
Figure 8:
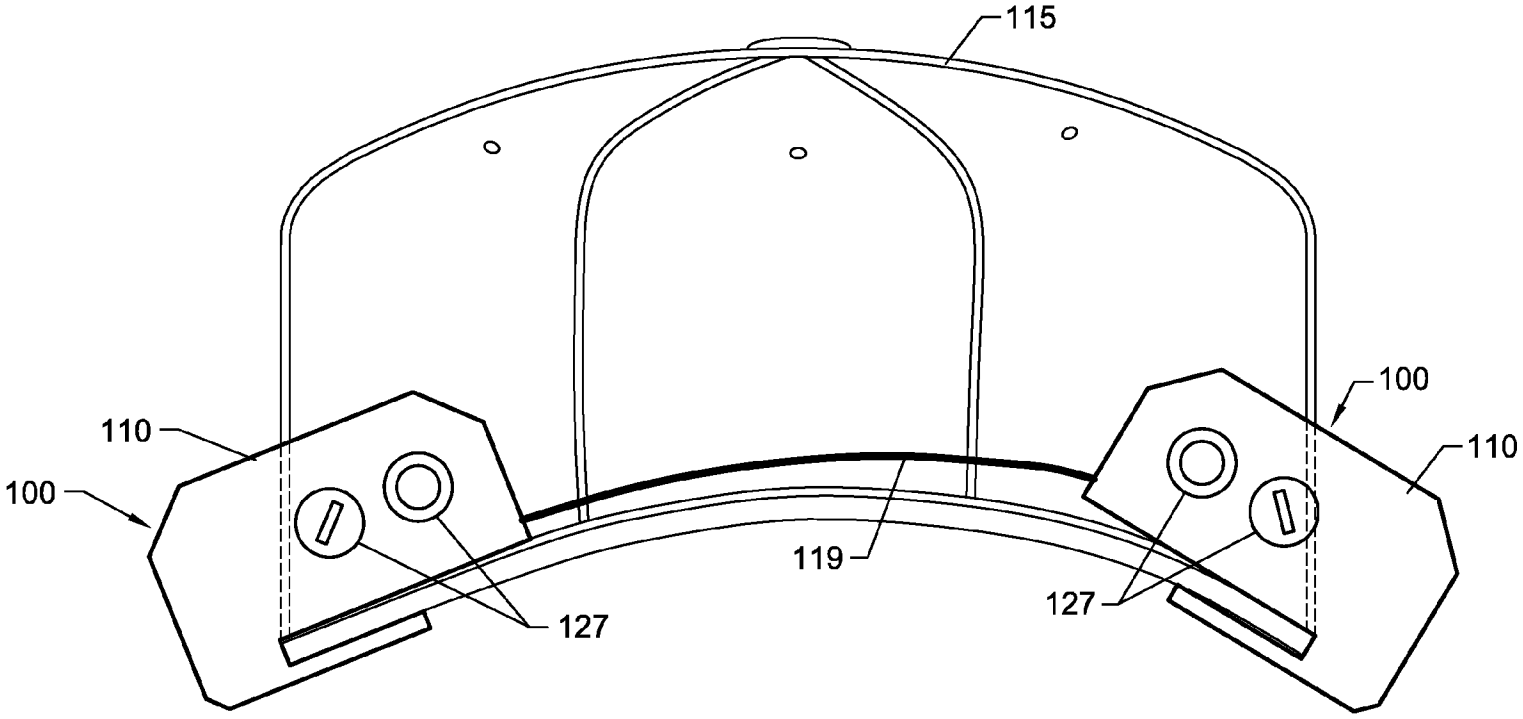
FIG. 8 is a front view of a hat on which two anchor point devices are connected.

The drawings also illustrate different types of cover support members which may be used in various embodiments of the invention. A type of cover support member that is particularly suited for the lower face cover support member 101 is shown in FIGS. 6 and 6A. This cover support member 101 includes a bendable and formable wire 136 extending the length of the cover support member. Wire 136 may be covered along its length with a plastic cover material. The end of cover support member 101 includes a length of resilient cover material 138 which includes a series of longitudinally-extending, resilient ribs 139. This end cover material 138 with ribs 139 extending along at least a portion thereof form a connector at the end of cover support member 101. This connector cooperates with a suitable receiver opening (such as 130 in FIGS. 6 and 134 in FIGS. 20-22) to provide a frictional engagement to releasably connect the cover support member 101 to the receiver base 110. The wire 136 employed in cover support member 101 may be bent by the user into a desired configuration to support the cover material in a position desirable for the particular user. Although wire 136 is bendable, it has sufficient strength to retain its shape while supporting the cover material (such as cover material 106 shown in FIGS. 14 and 16). The wire-type cover support member may be used for any of the cover support members employed in the present invention, and not just the lower face cover support member.

Figure 17:
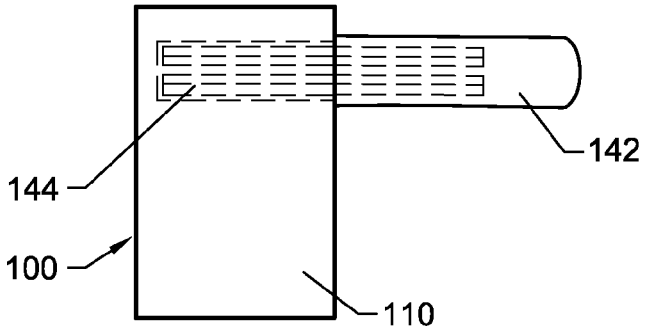
FIG. 17 is a diagrammatic representation showing an alternative cover support member connector according to an embodiment of the invention.
Figure 18:
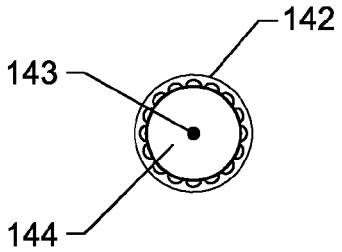
FIG. 18 is an end view of the alternate connector shown in FIG. 17.
Figure 19:
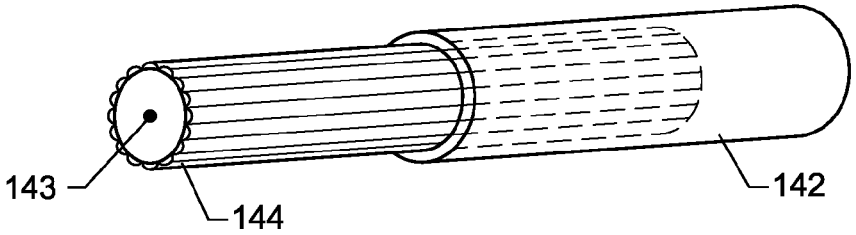
FIG. 19 is a view in perspective of the alternate connector shown in FIG. 17.

FIGS. 17-19 show another type of cover support member comprising a resilient tubing 142 having a length of wire 143 tightly received in the end of the tubing material. The wire 143 includes a resilient and ribbed cover material 144 so as to form a connector which functions similar to the covered wire-type connector shown in FIG. 6A.

As noted above, a cover support member may include simply a length of resilient tubing material. In this case, the resilient tubing material forms a connector which cooperates with the receiver opening (and perhaps a lug/bolt 127 as described above) to releasably connect the tubing material to the respective receiver base 110.

It should be noted that some cover support members may not rely on a resilient/frictional engagement with a receiver opening to releasably connect to receiver base 110. For example, a cover support member may comprise a length of covered or uncovered bendable and formable wire sized so that the end of the wire may be inserted completely through a receiver opening such as opening 134 shown in FIGS. 20-22, and then bent back on itself around the outside of the receiver base 110 to retain the respective end of the cover support member on the receiver base. This sort of cover support member is particularly useful for the side/back cover support member 103 and the upper face cover support member 102.

The anchor point devices 100 may be made of any suitable material (e.g., wood, plastic, metal, etc.). As illustrated, each anchor point device 100 may be in the form of simple "blocks" with a slot opening 118 designed to snugly receive the edge of a hat such as the bill of a typical baseball cap. Where anchor point devices 100 are made of plastic, such as by injection molding for example, a spring clip providing the function of clip 122 in FIGS. 20-22 may be integrally formed with the remainder of the anchor point device.

The outer portion of an anchor point device 100 in the connected position on a hat should extend beyond the edge of the bill (for baseball-type caps) to the minimum extent needed to provide room to construct the receiver openings, while at the same time not extending beyond the edge of the cap to the extent that it would be disruptive to aiming a gun, or shooting a bow, or represent an unsightly configuration on the cap. In one preferred embodiment, the anchor point devices are held in place primarily by the slot opening 118 or wire clip 122 into which the edge of the cap is emplaced, an elastic tether that connects to the anchor point devices 100 together across the top of the bill of the cap, and pin 120 (shown in FIG. 10) that penetrates slightly into the side of the brim of the cap so as to prevent slipping along the edge of the cap. The slot opening 118 or wire clip 122 can be of different dimensions in order to receive cap brims of different thicknesses. The anchor point devices 100 can also be held in place by forming the opening portion of the anchor point device to include a portion which is sized to be slightly smaller than the thickness of the bill of a typical baseball cap such that the "limbs" defined on either side of the opening are forced to spread slightly and the bill material is forced to "compress" slightly, as each anchor point device 100 is engaged. The resilient strength of the anchor point device limbs under "load", and friction, will create the holding forces necessary to keep the connected cover support member and cover sheet properly in place during use. Another form of the anchor point devices could utilize bifurcated spring loaded limbs, the holding force of which is created by the strength of the spring and limbs. In these two alternate forms utilizing spring force to grip the hat, the elastic tether and/or pin may not be needed or desired.

For all of the illustrated anchor point device receivers (111, 112, and 113), the receivers are openings into the receiver base material at the desired location. The receiver openings are sized to be slightly smaller than the outside diameter of the covered/coated wire segments (where wire-type connectors or cover support members are used) that are inserted into the receiver openings. The receiver openings may extend only part way into (not all the way through), the receiver base 110. The cover support member connectors that are to be used for connection of the side/back tubing and the lower face cover support member are installed from the back of the receiver base 110, oriented to align with the longitudinal axis of the cap (front to back). The cover support member connectors to be used for connection of the upper face cover support member are installed into the front of the receiver base 110, also oriented in the direction of the longitudinal axis of the cap.

The formable wire-type lower face cover support member 101 is preferably covered or coated with a material for the purpose of making the formable wire more convenient and pleasurable to handle. The coating can be of a plastic, rubber, or other flexible synthetic material as desired. In a preferred embodiment, the covering or coating has the longitudinal ribs 139 which create a slightly larger outside diameter. To install this type of lower face cover support member on each anchor point device 100, the respective end of the coated or covered wire is snugly pressed into the receiver opening. The installation force causes the ribs 139 to compress while being inserted and the compressed ribs help to create the frictional forces which prevent the structure from accidently being removed from the anchor point device. When its use is no longer desired, each wire end is simply physically pulled out of the respective receiver opening.

In one preferred embodiment, the structures that hold the upper face and the side/back sheets are made of individual lengths of a flexible tubing (such as tubing 124), which are connected at their ends to short segments of covered or coated wire as shown in FIGS. 17-19. The covered or coated wire segments are held in place at the ends of the tubing by sliding the segments approximately two to three inches into the open ends of the tubing. The dimensions of the outside diameter of the coated or covered wire, and the inside diameter of the flexible tubing, are such that the tubing/wire connection is tight so as not to be easily separated once installed. To install these tubing-type cover support members on the anchor point devices 100, the exposed coated or covered wire segments are simply pushed snugly into the respective receiver opening.

The cover sheets may comprise a fabric cut into a preferred pattern that, when in use, comfortably conforms to the shape of the body with which it may contact. For instance, the cover sheet material can be shortened over the shoulder area, and lengthened in the front and back areas. For warmth when desired, the forward portions of the side/back cover sheets can be designed so as to wrap across the face/mouth to aid in warmth.

To install a cover sheet on the respective cover support member, the sheet material is folded back on itself to form a loop and sewn along the entire top length of the cover sheet. The loop is sized to allow the easy insertion of the cover support member. The cover support members are then inserted into the loop and sheet material is pushed onto the cover support member until the length of the cover sheet is long enough to fully span the length of the cover support member between the two ends of the cover support member. As desired, sufficient cover sheet material is provided between the ends of the cover support member so as to provide a corrugated or "curtain" appearance when in use. The length of the side/back material is such that the cover sheet material may entirely cover the user's neck. The lower face cover sheet is sufficient in length so as to allow the cover sheet material to be tucked into, or clipped onto, the user's clothing. By this design, the cover sheet material can be controlled in heavy winds. To prevent the cover sheet material from sliding along the cover support member, the cover sheet material may be held in place by placing a heavy thread through the both the cover sheet material and the cover support member. The thread is tied off which prevents the cover sheet material from sliding relative to the cover support member. This "tie-off" is preferably placed in close proximity to each of the ends of the cover support member.

Other embodiments of the present invention may include cover support members which may be directly attached to a hat. In these embodiments, one or more cover support members would be connected at their respective ends with a suitable connecting device such as a suitable clip. The clips could then be separately attached to an edge of the hat.

It is also within the scope of this invention that all of the cover support members may be made of a variety of materials, including wire instead of flexible tubing.

As indicated in FIGS. 20-22, forms of the present invention may include three receivers on a given receiver base, with each receiver comprised of an individual hole drilled entirely through the receiver base and sized in diameter to enable the snug fitting of the cover support member end. By this design, the receiver bases are completely symmetrical and, therefore, can be attached to the cap on either side. In addition, by drilling the receiver holes all the way through the receiver base, the cover support member ends are permitted to extend all the way through the receiver base, thus allowing further adjustment to the cover support member functional dimensions.

It is also possible within the scope of the present invention that the side/back cover sheet can be installed without any separate cover support member. In this embodiment, a connector would be attached to the two ends of the cover sheet at the upper edge thereof and the sheet material would then be attached to the receiver bases by way of the connectors. The sheet material length between the connectors would be slightly shorter than the circumference of the hat/head and, therefore, the cover sheet would be held in position by the hat/head.

In various embodiments described above two anchor point devices provide the structural support upon which cover support members are connected. The anchor point devices are essentially "blocks" with dimensional grooves (slots), or wire "clips", sized to snugly receive the lateral edges of the hat bill or brim, and receivers are included to accept the flexible cover support members (tubing or coated/covered bendable wire), which holds the cover sheet material in the desired operating position.

In one or more embodiments, the anchor point devices are connected to each other by way of an elastic "tether" 119. To aid in holding the anchor point devices in position on the bill or brim of a hat, the tether 119 is positioned across the top of the bill or brim so as to provide inward force on the two anchor point devices. The inward force is resisted by the bill of the cap. Beyond the slot or wire clip and the tether, there is no need for other means of temporarily connecting the anchor point devices to the hat, such as hook and loop material, screws, magnets, snaps, buttons, spring clips, or the like, however, any such mechanism may be used if desired. Embodiments of the present invention allow the cover system to be quickly and easily installed on a hat as desired, and quickly and easily removed from the hat when the device is not needed. In addition, this design allows for the cover system to be quickly and easily removed from one hat and placed on another.

In one or more embodiments, two individual lengths of flexible tubing act independently as cover support members to which covering sheets may be attached. The individual cover support members fasten to the anchor point devices separately to support the upper face cover material and the side/back cover material. The user can selectively choose to use one or both of the cover support members.

In one or more embodiments, the upper face cover support member and the side/back cover support member are comprised of individual lengths of flexible tubing of the desired material, length, and diameter. The ends of the tubing are connected to short segments of a covered or coated bendable wire, and the outer surface of the coated or covered wire has longitudinal "ribs" 139 which will compress to aid in creating a frictional holding force when the ends are attached into the receivers included in the anchor point devices. To connect the tubing to the coated or covered wire segments, the flexible tubing is stretched tightly over a few inches of the covered or coated wire segment. A length of approximately 1 inch of the covered or coated wire segment is left exposed. This portion of the cover support member is the means by which the tubing is connected to the anchor point devices.

To attach these tubing-type cover support members to the anchor point devices, the exposed covered or coated wire segment ends are pressed into the respective receivers. The receivers are sized to be slightly smaller in diameter than the covered or coated wire segment outside diameter. When inserted into the receiver opening, the ribs 139 of the coating or covering material are "crushed" to create a "holding" force so the cover support structure does not inadvertently separate from the anchor point device. To remove, the cover support members are simply pulled away from the receivers.

When in place, the tubing-type cover support elements serve as flexible "tracks" along which the cover sheets "drape." For the upper face covering sheet material, once in place, the tubing-type cover support member rests on top of and across the top of the bill of the hat. The upper face cover sheet material that is held by the upper face cover support member drapes along and over the front edge of the bill and hangs in front of, but away from, the face so as to eliminate the uncomfortable feeling, disruption to breathing, disruption to wearing glasses, and providing for improved mosquito protection and for improved access to the mouth for eating/drinking and/or the use of hunting calls, whistling, etc. Because the upper face cover material hangs in front of the face, this material is preferably made of a see-through mosquito-net type fabric.

The tubing-type side/back cover support member wraps around the side and back of the head. The tubing length is sized to be slightly smaller than the "circumference" of the hat when being worn. By being sized slightly smaller, the side/back cover support member is supported and held in place by the hat/head. Being made of flexible tubing and fabric, when not in use, the tubing and cover fabric can be easily balled up and placed into one's pocket for later use.

In one or more embodiments, the lower face cover support member is comprised of a formable coated or covered wire. This wire-type cover support member may be attached to the anchor point devices in the same manner as described for the tubing-type cover support members (i.e., with the ends simply pressed into the receiver openings of the anchor point devices). The lower face cover material is draped onto the formable wire structure. The wire/fabric may be formed to the desire of the user, however, in a preferred embodiment the wire is shaped generally so as to create a "football face mask" type appearance. The top edge of the lower face wire-type cover support member is generally aligned to be at the bottom of the user's eye line. Formed in this manner, the lower face cover sheet material provides camouflage to the face, while being held away from the face in order to eliminate the discomfort caused by the contact with the skin. By resting below the user's line of sight, the user's vision is unobstructed. The amount of opening allowed for viewing is fully adjustable to the user's desire simply by forming the shape of the wire structure to allow more or less opening, as desired.

The material that may be used for the cover material sheets include a variety of materials depending on the intended use. For use as a face and head covering for hunting, bird watching or similar, the material could be a fabric in a camouflage pattern so as to blend into the natural cover conditions. For warmth, the materials could be of a heavier fabric (e.g., fleece, wool, fur, etc.). For coolness, the cover sheet materials could be lighter (e.g., cotton, netting, etc.). In addition, the cover sheet materials may be double printed, or two materials could be sewn together, so as to be reversible to give the user a choice with regard to the type of material, or pattern displayed, on the inside versus outside of the cover system.

The lower face cover material could be a heavier weight, non-see through material so as to provide additional camouflage or warmth, and/or minimize movement of the material in the wind. Because the lower face cover support member preferably comprises a formable wire structure designed to rest below the eye line of the user, the user's view remains unobstructed when only the lower face cover material is in use. Of course, in hot weather, a user could also use a lighter weight, or even see-through material, for the lower face covering if such was desired. When it is periodically desired to no longer use the lower face covering, the material may simply be lifted up and over the bill of the cap, and the cap positioned upward as necessary so as to move the lower face cover material and wire structure to a point above the eye line of the user. Alternatively, the formable wire structure and lower face cover material may be bent downward so as to remove the wire/cover material structure from the front of the face.

The upper face cover material may comprise relatively light-weight, see-through material such that the user's vision is not disrupted when the material is in use. The upper face cover material may be used when the user needs protection from flying/biting insects, or when the user anticipates coming into very close range of his game, at which time additional camouflage of the face may be preferred. To place the upper face covering into use, the user simply lowers the upper cover material down from the top of the hat. When no longer needed, the cover material is lifted and placed back to rest on top of the cap.

Like the lower face cover material, the side/back cover material could be of a heavier non-see through material (e.g., flannel, wool, etc.), for instances of cold weather where additional warmth is desired, or it could be of a lighter weight see-through material, for instances where additional air flow is desired. To use the side/back cover material, the cover material support member is placed onto the anchor point devices as described previously, and the cover material is allowed to fall along the user's side and back of the head. When its use is no longer desired, the side/back cover support member is removed from the receivers and the device can be balled up and conveniently stored in the user's pocket or other desired location.

In addition to using different types of materials, as described above, because the three covering structures are constructed and used independently of each other, each can be covered with a different patterned material. For instance, the upper face cover could utilize a mosquito netting, the lower face cover could be of a green-based camouflage pattern, and the side/back cover could be of a brown-based camouflage. In addition, the lower face and side/back covers could be printed differently on each side of the material such that, by simply removing and inverting the cover material, the opposite side of the cover material would be displayed. For instance, while turkey hunting, one side of the cover material could be in green camouflage pattern for the spring hunting season, and the other side could be in a Hunter's safety orange camouflage pattern. While walking to the blind, for safety purposes, the hunter could choose to display the orange side of the cover material so as not to be mistaken as game by other others in the area. Then after reaching the blind, the hunter could quickly and easily invert the lower face and side/back covers so as to hide the Orange and display the Green camouflage. Alternatively, for the recreational version, one material pattern may display a Christmas theme (e.g., Christmas colors), while the other material displays a New Year's Eve theme (e.g., fireworks).

In a recreational version of the device, the cover sheets could be made of a wider variety of materials, including a thin polyfoam, a heavy fabric (e.g., wool, flannel, etc.), or other material. The greater degree of variability in materials for the recreational version is due to the fact that attendance at a sporting event, or other recreational event, does not have the same degree of use considerations (e.g., aiming and shooting a rifle, the greater need for mosquito protection, etc.). One version of the side/back cover material could use a camouflage pattern on one side, and the user's favorite football team colors on the other side. When hunting, the device would display the camouflage pattern and while attending the football game the device would be constructed so as to display the colored side.

By constructing the cover support members and cover sheet materials as three separate pieces (i.e., upper face, lower face, and side/back), disruption to the side/back covering does not occur when lifting the separate face cover material. This makes moving the face cover material up and over the bill of the hat, or downward, easier than if the material was a single piece wrapping the sides and front of the user's head. As stated previously, this method of design and construction also allows for the use of different cover materials for the three different covering structures, as well as the option to use only the upper face, the lower face, the side/back covers, or all three at the same time.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. An apparatus comprising:

(a) a left receiver base including a left attachment surface;

(b) a right receiver base including a right attachment surface;

(c) a left hat connector associated with the left receiver base, the left hat connector operable to connect the left receiver base to a brim of a hat so that the left receiver base resides in a left operating position on a left side of the brim, in which left operating position the left attachment surface faces a surface of the brim in a first area of the brim spaced apart from an edge of the brim;

(d) a right hat connector associated with the right receiver base, the right hat connector operable to connect the right receiver base to the brim of the hat so that the right receiver base resides in a right operating position on a right side of the brim, in which right operating position the right attachment surface faces a surface of the brim in a second area of the brim spaced apart from the edge of the brim;

(e) a first left receiver formed in the left receiver base, the first left receiver comprising an elongated opening having a longitudinal axis extending through the left receiver base parallel to the left attachment surface, and having one end thereof residing in a surface of the left receiver base which extends transverse to the left attachment surface, the first left receiver residing above the first area of the brim when the left receiver base is in the left operating position;

(f) a first right receiver formed in the right receiver base, the first right receiver comprising an elongated opening having a longitudinal axis extending through the right receiver base parallel to the right attachment surface, and having one end thereof residing in a surface of the right receiver base which extends transverse to the right attachment surface, the first right receiver residing above the second area of the brim when the right receiver base is in the right operating position;

(g) an elongated first cover support member having a first end adapted to be inserted into the first left receiver and a second end adapted to be inserted into the first right receiver; and (h) a first cover sheet adapted to be secured along at least a portion of the length of the first cover support member.

2. The apparatus of claim 1 wherein:

(a) the elongated first cover support member comprises a length of wire;

(b) a first connector is located at the first end of the elongated first cover support member and is adapted to be received in either one of the first left receiver and the first right receiver; and (c) a second connector is located at the second end of the elongated first cover support member and is adapted to be received in either one of the first left receiver and first right receiver.

3. The apparatus of claim 2 wherein the first connector and the second connector each include a length of resilient connector material.

4. The apparatus of claim 3 wherein the length of resilient connector material is positioned over a respective end section of the elongated first cover support member, and wherein the length of resilient connector material includes radially outwardly projecting resilient rib extending longitudinally along at least a portion of the length thereof.

5. The apparatus of claim 1 wherein:

(a) the left receiver base further includes a second left receiver, the second left receiver being spaced apart from the first left receiver and comprising an elongated opening having a longitudinal axis extending through the left receiver base substantially parallel to the longitudinal axis of the first left receiver;

(b) the right receiver base further includes a second right receiver, the second right receiver being spaced apart from the first right receiver and comprising an elongated opening having a longitudinal axis extending through the right receiver base substantially parallel to the longitudinal axis of the first right receiver;

(c) an elongated second cover support member having a first end adapted to be releasably secured to the second left receiver and a second end adapted to be releasably secured to the second right receiver; and (d) a second cover sheet adapted to be secured along at least a portion of the length of the second cover support member.

6. The apparatus of claim 1 further including an elongated tether connected at a first end to the left receiver base and connected at an opposite end to the right receiver base.

7. The apparatus of claim 1 wherein the elongated first cover support member includes configurable sections which are bendable into a desired shape and retain that desired shape when released.

8. An apparatus comprising:

(a) a left receiver base having a left attachment surface;

(b) a right receiver base having a right attachment surface;

(c) a left clip connected to the left receiver base and being operable to connect the left receiver base to a brim of a hat so that the left receiver base resides in a left operating position on a left side of the brim, in which left operating position the left attachment surface faces a surface of the brim in a first area of the brim spaced apart from an edge of the brim;

(d) a right clip connected to the right receiver base and being operable to connect the right receiver base to the brim of the hat so that the right receiver base resides in a right operating position on a right side of the brim, in which right operating position the right attachment surface faces a surface of the brim in a second area of the brim spaced apart from the edge of the brim;

(e) a first left receiver opening formed in the left receiver base, the first left receiver opening comprising an elongated opening having a longitudinal axis extending through the left receiver base parallel to the left attachment surface, and having one end thereof residing in a surface of the left receiver base which extends transverse to the left attachment surface, the first left receiver opening residing above the first area of the brim when the left receiver base is in the left operating position;

(f) a first right receiver opening formed in the right receiver base, the first right receiver opening comprising an elongated opening having a longitudinal axis extending through the right receiver base parallel to the right attachment surface, and having one end thereof residing in a surface of the right receiver base which extends transverse to the right attachment surface, the first right receiver opening residing above the second area of the brim when the right receiver base is in the right operating position;

(g) an elongated first cover support member having a first end adapted to be inserted into the first left receiver opening, and a second end adapted to be inserted into the first right receiver opening; and (h) a first cover sheet adapted to be secured along at least a portion of the length of the first cover support member.

9. The apparatus of claim 8 wherein:

(a) the elongated first cover support member comprises a length of wire which is bendable into a desired shape and retains that desired shape when released;

(b) a first connector is located at the first end of the elongated first cover support member; and (c) a second connector is located at the second end of the elongated first cover support member.

10. The apparatus of claim 9 wherein the first connector and the second connector each include a length of resilient connector material.

11. The apparatus of claim 10 wherein the length of resilient connector material is positioned over a respective end section of the elongated first cover support member, and wherein the length of resilient connector material includes radially outwardly projecting resilient ribs extending longitudinally along at least a portion of the length thereof.

12. The apparatus of claim 11 wherein the elongated first cover support member comprises a length of metal wire having a plastic sheath along at least a portion of the length of the metal wire.

13. The apparatus of claim 8 wherein:

(a) the left receiver base also has a second left receiver opening formed therein, the second left receiver opening being spaced apart from the first left receiver opening and comprising an elongated opening having a longitudinal axis extending through the left receiver base substantially parallel to the left attachment surface;

(b) the right receiver base also has a second right receiver opening formed therein, the second right receiver opening being spaced apart from the first right receiver opening and comprising an elongated opening having a longitudinal axis extending through the right receiver base substantially parallel to the right attachment surface;

(c) an elongated second cover support member having a first end adapted to be releasably received in the second left receiver opening and a second end adapted to be releasably received in the second right receiver opening; and (d) a second cover sheet adapted to be secured along at least a portion of the length of the second cover support member, the second cover sheet comprising a second sheet of flexible material.

14. The apparatus of claim 8 further including an elongated tether connected at a first end to the left receiver base and connected at an opposite end to the right receiver base.

15. An apparatus for use with a hat, the apparatus comprising:

(a) two anchor point devices, each anchor point device adapted to releasably connect to the hat at a respective lateral edge of a brim of the hat and having a respective first and second receiver opening;

(b) an elongated first cover support member adapted to be releasably secured at each end in a respective one of the first receiver openings so as to be positioned in a first support position on the hat when the two anchor point devices are each releasably connected at the respective lateral edge of the brim, the first cover support member comprising a length of bendable and formable material which extends along each lateral side of the hat rearwardly from the anchor point devices when in the first support position;

(c) a cover sheet having a size sufficient to extend downwardly around at least a portion of the periphery of the hat when the cover sheet is in an operating position on the hat, the cover sheet adapted to be releasably secured to the first cover support member in the first support position to retain the cover sheet in the operating position on the hat;

(d) an elongated second cover support member adapted to be releasably secured at each end in a respective one of the second receiver openings so as to be positioned in a second support position on the hat when the two anchor point devices are each releasably connected at the respective lateral edge of the brim, the second cover support member in the second support position extending forwardly from the anchor point devices; and (e) a second cover sheet connected along at least a portion of the length of the second cover support member so as to reside in a respective operating position on the hat.

16. The apparatus of claim 15 wherein:

(a) the first cover support member includes a first connector at a first end thereof adapted to be received in one of the first receiver openings to secure the first end of the first cover support member to the respective anchor point device;

(b) the first cover support member includes a second connector at a second end thereof adapted to be received in one of the first receiver openings to secure the second end of the first cover support member to the respective anchor point device;

(c) the second cover support member includes a respective connector at a first end thereof adapted to be received in one of the second receiver openings to secure the first end of the second cover support member to the respective anchor point device; and (d) the second cover support member includes a respective connector at a second end thereof adapted to be received in one of the second receiver openings to secure the second end of the second cover support member to the respective anchor point device.

17. The apparatus of claim 16 wherein the first connector and the second connector each include a length of resilient connector material.

18. The apparatus of claim 17 wherein the length of resilient connector material is positioned over a respective end section of the elongated first cover support member, and wherein the length of resilient connector material includes radially outwardly projecting resilient ribs extending longitudinally along at least a portion of the length thereof.

19. The apparatus of claim 15 further including an elongated tether connected at a first end to a first one of the anchor point devices and connected at an opposite end to the other one of the anchor point devices.

* * * * *